United States Patent [19]

Wernli et al.

[11] Patent Number: 5,072,389

[45] Date of Patent: Dec. 10, 1991

[54] MODULAR INTERLINKED MARINE FIRE-CONTROL SYSTEM AND METHOD FOR COMPENSATING ALIGNMENT ERRORS IN SUCH MODULAR INTERLINKED MARINE FIRE-CONTROL SYSTEM

[75] Inventors: Andreas Wernli, Nürensdorf; Andreas Friedli, Marthalen, both of Switzerland; Narayana M. Vepa, Bodman, Fed. Rep. of Germany; Essameddin Badreddin, Zürich, Switzerland

[73] Assignee: Oerlikon Contraves AG, Zurich, Switzerland

[21] Appl. No.: 476,774

[22] Filed: Feb. 8, 1990

[30] Foreign Application Priority Data

Feb. 16, 1989 [CH] Switzerland ..... 00541/89

[51] Int. Cl.[5] ..... F41G 5/20

[52] U.S. Cl. ..... 364/423; 89/41.14

[58] Field of Search ..... 364/423; 89/41.14

[56] References Cited

U.S. PATENT DOCUMENTS 3,737,630 6/1973 Cox et al. ..... 89/41.14
3,803,387 4/1974 Lackowski ..... 369/423
4,541,323 9/1985 Sadler et al. ..... 89/41.14
4,553,493 11/1985 Sadler et al. ..... 89/41.14
4,616,127 10/1986 Whiting ..... 364/423

FOREIGN PATENT DOCUMENTS 1236806 3/1967 Fed. Rep. of Germany .
2125780 12/1972 Fed. Rep. of Germany .

*Primary Examiner*—Salvatore Cangialosi
*Attorney, Agent, or Firm*—Sandler, Greenblum & Bernstein

[57] ABSTRACT

The marine fire-control system preferably comprises several subsystems, each having a target detection module and at least one effector module. The subsystems and/or the modules are extensively interlinked and contain means for compensating static, quasi-static and dynamic alignment errors. By means of at least one computer unit, the data determined by respective sensors are evaluated and the compensation parameters representing the alignment errors between the individual subsystems and/or between the modules are determined. The processing of these movement data permits taking into account, during operation, the dynamic position changes between the subsystems or between the modules, respectively. Preferably, a permanent monitoring takes place by a safety or control system, which monitoring automatically or indirectly leads to an optimized coupling of effector modules and target detection modules.

21 Claims, 5 Drawing Sheets

MODULAR INTERLINKED MARINE FIRE-CONTROL SYSTEM AND METHOD FOR COMPENSATING ALIGNMENT ERRORS IN SUCH MODULAR INTERLINKED MARINE FIRE-CONTROL SYSTEM

CROSS-REFERENCE TO RELATED PATENT APPLICATION

This application is related to the commonly assigned, co-pending United States patent application Ser. No. 07/294,489, filed Dec. 9, 1988, and entitled: "ALIGNING PROCEDURE FOR A FIRE CONTROL DEVICE AND A FIRE CONTROL DEVICE FOR CARRYING OUT THE PROCEDURE"

BACKGROUND OF THE INVENTION

The present invention broadly relates to the alignment of weapon systems and pertains, more specifically, to a new and improved modular interlinked marine fire-control system. The present invention also relates to a new and improved method of compensating alignment errors in such a modular interlinked marine fire-control system.

Generally speaking, the modular interlinked marine fire-control system of the present development is of the type comprising a plurality of subsystems, each subsystem comprising at least one target detection module and a predetermined number of effector modules operatively associated with the at least one target detection module. The target detection modules and the effector modules are aligned relative to each other and contain means for compensating static and quasi-static alignment errors.

In the practice of the method of compensating alignment errors in a modular interlinked marine fire-control system, there are utilized equipment correction values provided ex-works of the target detection and effector modules and measured values of the coarse position of the installed target detection and effector modules, which coarse position is measured while still in the dock.

The use of fire-control systems on modern warships is allied to the difficulty that, in addition to the deviations dependent on the construction and geometry of the ship or vessel and to equipment tolerances of the target search and tracking units as well as of the effectors, distortions and other temporary deformations are caused during operation by the movements of the ship or vessel due to the motion of the sea, the pitching and the manoeuvring of the ship or vessel. Thus, for example, there can occur a longitudinal bending in a substantially vertical plane, and, if the ship or vessel lists or rolls or does not intersect or cut the waves at a right angle, there can also occur a horizontal bending of the hull. At greater sea forces of 8 to 9, pitching impact may also cause plastic, i.e. permanent deformations. As long as the warships are comparatively small, for example, equipped with only one gun or weapon and a radar, these movements of the ship are not of greater concern. However, on larger ships, in rough sea or during rapid manoeuvring, such movements of the ship may cause considerable elevational movements, and this has an extremely adverse effect on the geometric alignment between the effectors and the target search and tracking units, i.e. the sensor units, and results in errors when the effectors are directed to the target on the basis of the target data determined by the sensor units. These problems become all the more crucial, the greater the distance is between the sensor units and the weapons.

In particular, in the case of large and modern warships, a plurality of effectors, such as launchers and guns, are used nowadays, such effectors being controlled by one or several target measuring systems. These units or installations are distributed across the entire ship and, accordingly, are located at relatively large distances from one another. Therefore, there is a greater need for accurate alignment and compensation of alignment errors under conditions hereinbefore described. This may also result in the fact that corresponding precautions even become a necessity, in order to achieve adequate accuracy of the fire-control system.

The following remarks relating to the object of the present invention as well as the description of the invention are exemplified mainly in conjunction with embodiments comprising guns and radar systems, but they likewise apply to other effectors or weapons and target measuring systems which comprise other sensors such as, in particular, electro-optical target tracking units.

Normally, effectors and target search and tracking units are organized or arranged in subsystems, wherein, for example, per subsystem there are provided one radar and two guns, the two guns being controlled by the radar. These subsystems are arranged at relatively small distances from one another and are mounted at unit or standard type platforms, so that the arrangement can be regarded as quasi rigid. During combat, but also as a result of revision or repair work or material defects, failures in individual equipment units may occur, such failures reducing operational readiness of the associated subsystem or even causing total outage thereof. As a matter of fact, it would then be desirable to couple modules of different subsystems and to make use of theoretical passive redundancy of the overall system. It thus becomes evident that error compensation has to meet requirements which cannot be met by known conventional systems.

In the past, various efforts were made to at least partially overcome the manifold problems of marine fire-control systems. In German Patent No. 3,150,895, published July 14, 1983 and its cognate British Patent No. 2,112,965, published July 27, 1983 there is described a warship, in which static errors are corrected by the control signals of electronic control devices which store the bedding error values of the individual controlling units and controlled units. It is true that by taking into account the alignment errors or bedding errors, the accuracy of the fire-control system can be improved, but dynamic errors caused in action by the movement of the ship while underway are not taken into account. According to these prior art publications, the units or installations are, in fact, partially connected by lines, but for the control of units or installations which are not arranged at a common standard type platform, large deviations between radar and guns occur as a result of dynamic bending effects, such deviations being by no means tolerable. However, notwithstanding the connecting lines, an overall system utilizing passive redundancy has been in no way realized.

SUMMARY OF THE INVENTION

Therefore, with the foregoing in mind, it is a primary object of the present invention to provide a new and improved modular interlinked marine fire-control system and a new and improved method of compensating alignment errors in such a modular interlinked marine fire-control system, which system and method do not suffer from the aforementioned drawbacks and shortcomings of prior art fire-control systems and methods for compensating alignment errors.

Another important and more specific object of the present invention aims at providing a new and improved modular interlinked marine fire-control system and a new and improved method of compensating alignment errors in such a system, so that static and quasi-static as well as dynamic deviations between effectors and target search and tracking units are compensated and that, furthermore, a high accuracy and, by means of an efficient safety or control system, an optimization of the operational readiness of the entire fire-control system and a high reliability of operation can be achieved. In this manner, it is possible to include the redundancy of the overall system in the operational process.

Now in order to implement these and still further objects of the invention, which will become more readily apparent as the description proceeds, the modular interlinked marine fire-control system of the present development is manifested, among other things, by the features that each subsystem contains at least one sensor for detecting dynamic alignment errors of the subsystems and their associated at least one target detection module and the predetermined number of effector modules relative to each other. At least one computer is connected to the at least one sensor of each subsystem and at least one control computer is connected to each one of the predetermined number of effector modules in each subsystem. The at least one computer in each subsystem is connected to the at least one control computer connected to each one of the effector modules in the associated subsystem for transmitting thereto data for compensating the dynamic alignment errors of the subsystems.

The at least one sensor of each subsystem constitutes a sensor at the target detection module and a further sensor at each one of the predetermined number of effector modules associated with the target detection module.

The at least one computer is connected to the sensor at the target detection module and the further sensor is connected to the control computer in each one of the predetermined number of effector modules.

As alluded to above, the invention is not only concerned with the aforementioned features of the new and improved modular interlinked marine fire-control system, but also deals with a new and improved method of compensating alignment errors in such a modular interlinked marine fire-control system. According to the invention, the method aspects of the present development contemplate undertaking compensation of static, quasi-static as well as dynamic alignment errors, wherein the following steps are carried out:

(a) Determining at regular intervals compensation parameters of the static and quasi-static alignment errors, the parallax distances between the target detection modules and the effector modules of each subsystem, as well as compensation parameters of the alignment errors and parallax distances between the different subsystems;

(b) Continuously determining dynamic angle increments and axial velocity increments and corresponding angular changes and relative velocities of the subsystems and/or of the target detection module and the effector modules in each subsystem;

(c) Real-time processing the data determined according to method step (b) by means of a system algorithm and determining, in conjunction with data determined according to method step (a), the compensation parameters representing the static, quasi-static and dynamic alignment errors, and determining correction matrixes between the individual subsystems and between the target detection modules and the effector modules; and (d) Using these compensation parameters for the control of the effector modules and taking into account in the control operation at least the compensation parameters determined according to method step (a).

The modular interlinked marine fire-control system constructed according to the invention preferably comprises several independent subsystems, each having a radar unit and at least one gun or weapon unit. In addition, the individual equipment modules can be interlinked in such a manner that several radar modules and gun or weapon modules are connected each to one another, or the entire fire-control system forms a single, complex interlinked unit. The subsystems are interlinked in such a manner that, in the event of a failure of one radar unit, the radar unit of another subsystem takes over the function of the defective radar unit within a very short time, so that by virtue of utilizing the passive redundancy of the system a high reliability of operating of the overall system is ensured. Because of this interlinking and a corresponding control in the event of failure of an equipment module, the operational readiness of the entire fire-control system can be optimized.

The construction-dependent alignment errors existing within the subsystems between the radar unit and the gun units can be regarded as quasi-static and are taken into account in the gun control. These construction-inherent deviations of the position or of the equipment geometry change only slowly, i.e. over a period of weeks, so that there is preferably used an aligning process for determining the deviation parameters, and which aligning process is carried out at regular intervals. As long as the units of a subsystem are arranged at a substantially small distance from one another on the hull of the ship, only slight relative movements will occur even in the event of a heavy or rough sea, so that in most cases a compensation of the static errors will already provide adequate accuracy. Therefore, the dynamic errors within a subsystem can be neglected. The same applies to equipment units of different subsystems which equipment units are located very close together. This is particularly of importance in the event of uniform interlinking of the marine fire-control system.

However, the interaction of gun units with a radar which belongs to another subsystem, such interaction rendered possible by the interlinking of the subsystems, generally entails that larger distances exist between the respective units. As a result thereof, dynamic errors caused by movements of the ship become substantially significant and thus require compensation by a suitable aligning method. For this purpose, each subsystem, optionally each equipment module, is provided with a measuring means which determines the rapid movements of this subsystem or equipment module, respectively. The processing of these movement data renders possible that the dynamic changes of position between the subsystems or between the equipment modules are taken into account during operation. The errors caused by the static deviations can be determined from the known deviation parameters within the subsystems as well as from the measured position of the subsystems with respect to one another and can likewise be taken into account together with the dynamic deviation values.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the modular interlinked marine fire-control system and of an arrangement for performing the inventive method for compensating alignment errors has been illustrated therein as is needed to enable one skilled in the art to readily understand the underlying principles and concepts of this invention.

Turning attention now to the figures of the drawings, the preferred embodiments illustrated therein by way of example and not limitation will be hereinafter described in four chapters I through IV:

I. Concept of a complex interlinked system

Figure 1:
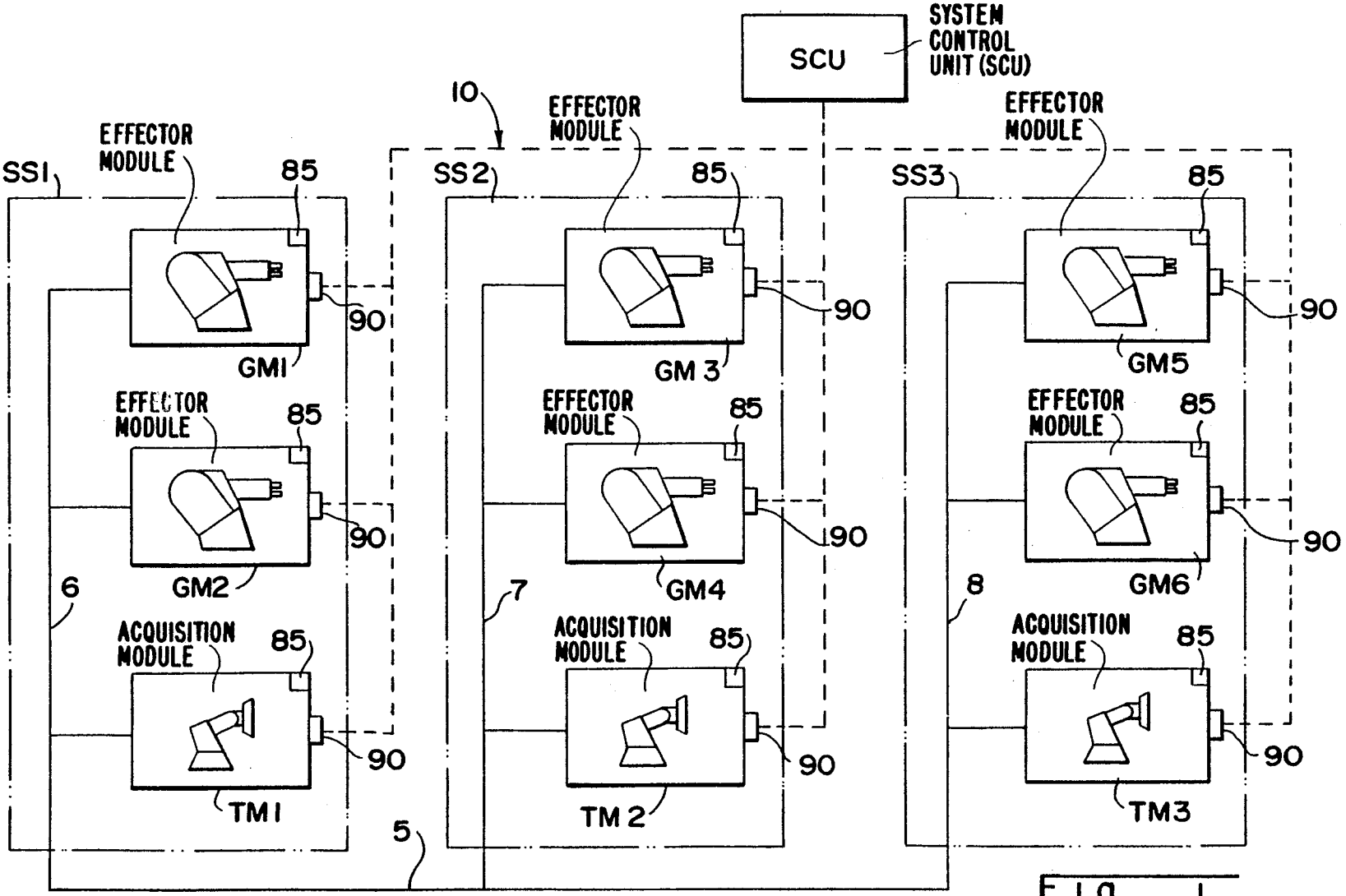
FIG. 1 schematically shows an exemplary embodiment of a modular interlinked fire-control system having three subsystems.

In order to obtain on a warship an optimum readiness for action as well as weapons delivery accuracy, it is the object of the present invention to optimize the overall system. The individual equipment groups, i.e. for instance a radar with two guns, are not considered detached from the overall system, but are dealt with as part thereof. In order to realize a corresponding operational system, the fire-control system is interlinked in a comprehensive manner. The fire-control system constructed according to the invention preferably comprises several independent subsystems, each subsystem having a radar unit and one or more guns or weapons. An example of such an arrangement having three subsystems SS1, SS2 and SS3, each subsystem provided with modules GMi and TMi, is schematically depicted in FIG. 1. Independence in this connection means that the equipment modules GMi and TMi within a subsystem SSi interact or cooperate without additional data or control parameters of other subsystems and, therefore, can also be used when detached or disassociated from the overall system. Although the equipment constructed according to the invention and the inventive method are hereinafter described mainly in conjunction with an exemplary embodiment comprising individual subsystems, it should be emphasized that also other interlinking systems of the individual equipment modules are possible or may even be preferred for special applications. It is evident that the inventive method is not restricted to gun modules and radar modules, but can also be used in connection with other effectors and target detection or acquisition systems, for example, missiles and optical target detection or acquisition systems, or other suitable equipment.

The object of the invention aims at providing a fire-control system with the greatest possible reliability and accuracy. To this end, according to the invention the individual modules GMi and TMi of the fire-control system are interlinked in a suitable manner, so that a passive or, in special cases, an active redundancy of the system is not only achieved but also utilized. At the same time, measuring and regulating means are provided and which are able to correct static, quasi-static as well as dynamic errors in the control, and this—as set forth hereinafter—is a prerequisite for adequate system accuracy. To monitor and optimize the readiness for action of the fire-control system, and to be able to utilize the flexibility of the system realized by interlinking, a safety or control system is provided. A safety system as well as a self-monitoring or self-regulation of the system can be used. Since the safety system must comprise at least one central monitoring or control unit such as a system-control unit SCU depicted in FIG. 1, several independent and basically different protection systems are preferably used to increase safety and reliability. This system-control unit SCU is connected to all modules GMi and TMi via common data lines or by means of separate data lines indicated by broken lines in FIG. 1, and controls the readiness for action and the interaction of the individual modules GMi and TMi.

The target detection or acquisition modules TMi as well as the effector modules GMi are preferably constructed as readily interchangeable units, this rendering possible a relatively simple and accurate installation. This concept also permits in the simplest manner a subsequent refitting of old warships of various types or models. The target detection or radar modules TMi are connected each via a common data line 5 to the subsystem-internal data lines 6, 7 and 8 of the other subsystems SSi.

Special attention must be drawn to the fact that, within the framework of the invention, the terms "interlinked" and "connected" are to be understood as functional terms. Therefore, it is not necessary, or it may be useful or even requisite for special embodiments, that the "connections" are not physically structured by means of electric lines. The interlinking may rather be ensured by a suitable radio circuit or link or other data transmission systems. In this connection, special importance must be placed upon a transmission that functions reliably. In this respect, cabled systems are advantageous. A redundant interlinking additionally increases reliability of operation as well as operational safety.

The basic interlinking of such a marine fire-control system is depicted in FIG. 1. The measuring and regulating data which are required for taking into account the deviation with respect to relative alignment, are available via a data network 5, 6, 7 and 8. The system-control unit SCU, in turn, is connected to the individual equipment modules GMi and TMi by means of a second data network 10. Via this second data network 10, there are available data regarding readiness to fire, malfunctions, for example, vibrations, defects, failures and the like, accuracy of the modules GMi and TMi and so forth, and at the same time this data network 10 serves as a network for the control data of the system-control unit SCU. Naturally, the data network 5 through 8 and the data network 10 can also be constructed as a single or common data network. The data made available to the system-control unit SCU provide the decision basis or calculation basis for an optimization of the connections of the modules realized in each case.

II. Interlinking for compensating alignment errors

Figure 2A:
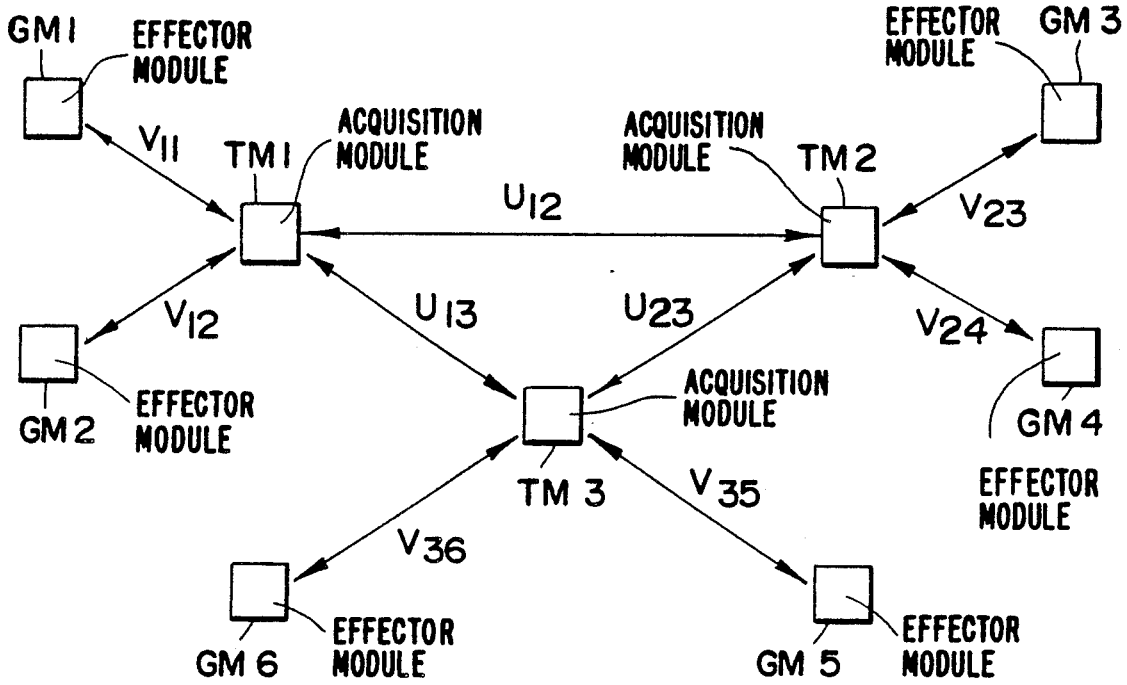
FIG. 2A shows a first basic concept for detecting alignment errors within a fire-control system.
Figure 2B:
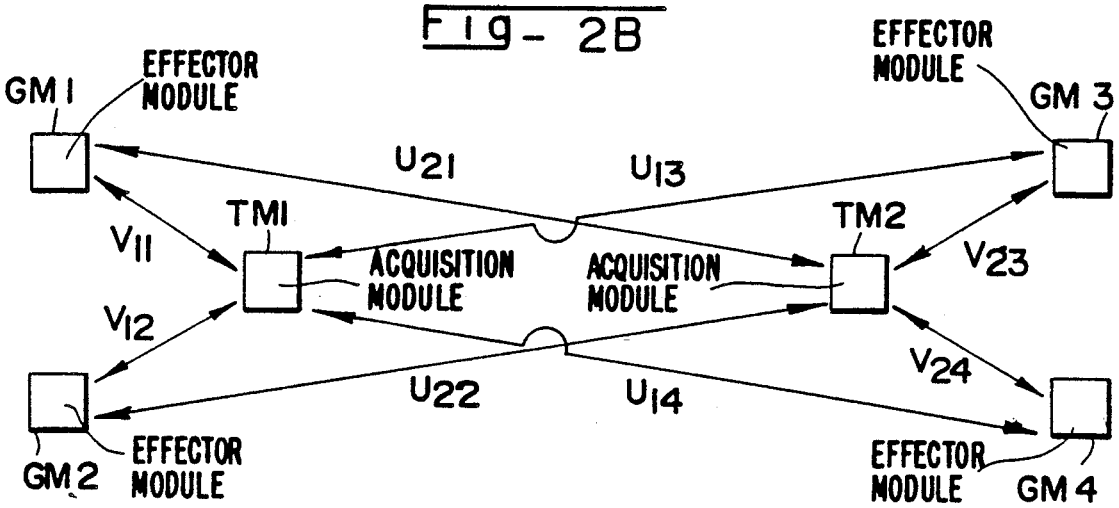
FIG. 2B shows a second basic concept for detecting alignment errors within a fire-control system.

Central to the invention is the compensation of as many as possible of the alignment errors of the modules. In FIGS. 2A and 2B there are schematically illustrated two methods for considering or taking into account alignment errors within a fire-control system. The following description refers to a system with N subsystems and M effector modules, i.e. guns GMi, whereby each subsystem comprises a target detection or acquisition module, i.e. a radar TMi. The compensation parameters or correction vectors for compensating alignment errors between the subsystems are indicated by $U_{ij}$, those within a subsystem are indicated by $V_{ij}$. The method according to FIG. 2A detects the alignment errors within a subsystem and between the individual subsystems. The total number of correction vectors $V_{ij}$ and $U_{ij}$ to be taken into account is $Z_1=M+N\cdot(N-1)/2$.

If, for example, the radar module $TM_1$ must take over the control of the gun module $GM_5$, the correction vector is equal to $U_{13}+V_{35}$.

The second method according to FIG. 2B detects the correction vectors between all radar modules TMi and gun modules GMi. For reasons of simplicity and clarity the fire-control system in FIG. 2B has been illustrated with only two subsystems. The total number of correction vectors is $Z_2=M\cdot N$.

Figure 3A:
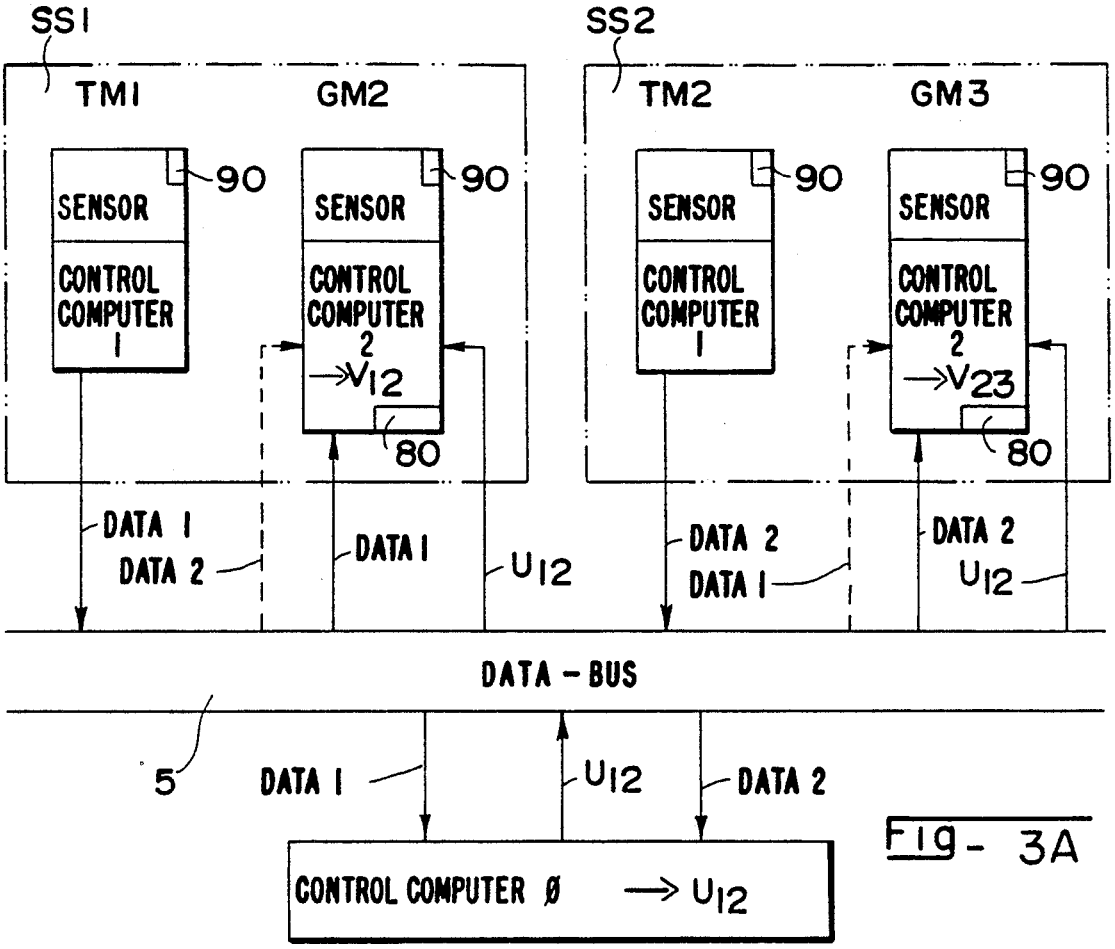
FIG. 3A shows a first exemplary embodiment of the interlinking of the individual modules and subsystems.
Figure 3B:
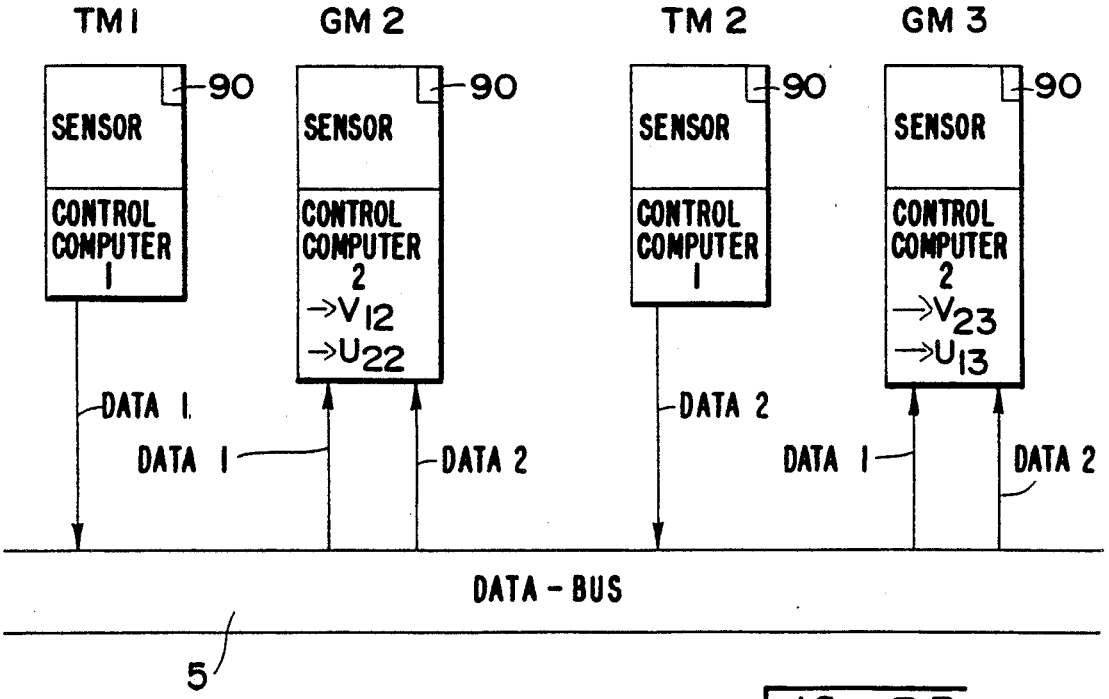
FIG. 3B shows a second exemplary embodiment of the interlinking of the individual modules and subsystems.

Possibilities for suitable interlinking of the modules are depicted in FIGS. 3A and 3B. Here a common data bus 5 is provided, such data bus 5 being connected to each one of the individual modules GMi and TMi. The data flow can likewise be seen in FIGS. 3A and 3B, whereby the broken lines depict the data flow which takes place in the event of disturbances in a subsystem. In both variants there are provided decentralized computers COMP1 and control computers COMP2 which serve for evaluating the data supplied by sensors SENS.

In FIG. 3A an additional computer unit COMP 0 is provided for determining the alignment errors between the individual subsystems. As can be seen from the illustrations in FIGS. 3A and 3B, the individual target detection modules TM1 and TM2 are provided each with a computer COMP1 and the individual effector modules GM2 and GM3 are provided each with a control computer COMP2 which may include control elements 80. The distribution of computational work to the individual computers may vary depending on the application. Preferably, the gun modules are only supplied with correction data which are evaluated by the associated computer units, i.e. the actual compensation data for the control of the guns are determined by the control computer units COMP2 of the effector modules GMi. The two methods of error correction differ with regard to redundancy, reliability between the subsystems or within the subsystems, computational work and loading of the individual computer units COMP1 and COMP2 and other factors, so that depending on the given requirements the one or the other variant can be selected. As can readily be seen, the interlinking of the modules according to FIG. 3B is particularly suitable for achieving an active redundancy.

III. Types of alignment errors and consideration of such alignment errors

The manner of interlinking and the error correction devices, for example, the required sensors, are closely interrelated or interdependent. A modular interlinked marine fire-control system can only be employed effectively, when with the interlinking of modules there is still ensured an adequate precision which, in turn, depends on the disturbance factors hereinafter listed:

| location | slow errors (static + quasi-static) | fast errors (dynamic) |
|---|---|---|
| within a module | 1 geometry tolerances of the equipment | 2 elastic stresses and vibrations of the effectors or the trackers |
| within a subsystem | 3 bedding errors etc. | 4 elastic movements and vibrations of the ship's body between the beddings |
| between subsystems | 5 bedding errors, deformations of the ship's body etc. | 6 dynamic movements of the ship, distortions etc. |

In order to obtain accurate control or alignment of the individual effectors or guns, all mutual or relative movements of the target axis of radar and gun would have to be taken into account, i.e. dynamic disturbance factors of the types 2, 4 and 6 listed in the above table as well as all static and quasi-static disturbance effects of the types 1, 3 and 5 listed in the above table. Therefore, a multitude of deviations would have to be considered, whereby in view of the practical use or actual operation, the switching, interlinking and computational expenditure or work would have to be subject to certain restrictions. For this reason and in accordance with the inventive method, preferably certain alignment errors, which are hardly anything but insignificant for practical service or operation, are neglected and therefore not compensated.

Basically, a distinction can be made between two different types of alignment errors. According to the foregoing list of possible misalignments or alignment errors, there occur, on the one hand, dependent upon the constructional conception, static or quasi-static errors between the individual units or modules of the subsystems as well as in the relative position of the subsystems with respect to one another, such errors changing only slowly, i.e. over periods of days and even weeks. Such changes in the geometry of the ship or of the equipment occur, for example, due to the loading and unloading of the ship, or due to external action or effects such as a collision, butting or contact, severe vibrations and rough sea as well as due to ageing of the material and the like. In addition, all mechanical parts, equipment units and the like comprise bedding clearance and manufacturing tolerances.

On the other hand, dynamic errors are caused by the motion of the sea and by the manoeuvring of the ship. These dynamic errors, normally in the range of up to about five cycles per second, lead to relative movements of the modules with respect to one another and short-time elastic deformations. The static as well as the dynamic errors occur within the individual modules, within a subsystem as well as between the various subsystems, and superimpose or overlap one another. By means of suitable sensors and computational evaluation of the thereby measured results as well as of known correction data, equipment correction values, offset values and the like, the alignment errors of the types 1 and 3, 4, 5 and 6 listed in the above table are taken into account by the inventive method. The dynamic errors within the individual modules would require additional sensors and evaluating units, whereby the corresponding corrections would be carried out within the modules themselves.

III. A. Compensation of static and quasi-static alignment errors

Examples of possible sensors and evaluating methods for determining the correction data will be hereinafter described. The inherent parameters of the radar modules TMi and the gun modules GMi, or the measured values of the installed or assembled units are measured and stored in the usual manner. The alignment errors caused by manufacturing tolerances and by the assembly or mounting are subject to only minor temporary fluctuations and can be regarded to be quasi-static. However, the possibilities for a mechanical correction of deviations of the relative alignment of various modules with respect to one another, particularly of modules in different subsystems, are limited and a correction or compensation of manufacturing and mounting tolerances by means of solely mechanical measures provides unsatisfactory results. It is thereby particularly not possible, for example, to mechanically simultaneously adjust or range a gun module GMi to different radar modules TMi. If a gun module GMi has to be controlled by a radar module TMi of another subsystem, it must be taken into account that the ship's hull, notwithstanding the fact that its geometry remains quasi-static over a longer period of time, necessitates a regular relative adjustment of the modules with respect to one another.

To determine the quasi-static alignment errors, there is preferably carried out a regularly and readily repeatable adjustment or compensation subsequent to installation of the fire-control system. For this purpose, the individual modules each possess a target detection or acquisition sensor 85 (FIG. 1) defining a target measuring line-of-sight and which can detect a measuring or test target with an accuracy of a few tenths of an angular minute. By simultaneous tracking of a measuring or test target by a gun module and a radar module and by comparing the measured values, the deviation of the control values established by the radar for correct alignment of the gun module can be determined and likewise stored. Preferably several measurements are effected, for which a moveable measuring or test target, for instance a helicopter with a target body, is used. A checking and renewed storing of these compensation parameters determined in this manner will therefore only be required from time to time, at intervals of days or even weeks. Such a method for determining the compensation parameters for static error correction is disclosed, for example, in the cross-referenced co-pending United States patent application Ser. No. 07/294,489, filed Dec. 9, 1988. During operation, the stored compensation parameters are electronically or computationally evaluated during alignment of the gun modules, and the control data for the guns are corrected accordingly.

III. B. Compensation of dynamic alignment errors

Figure 4:
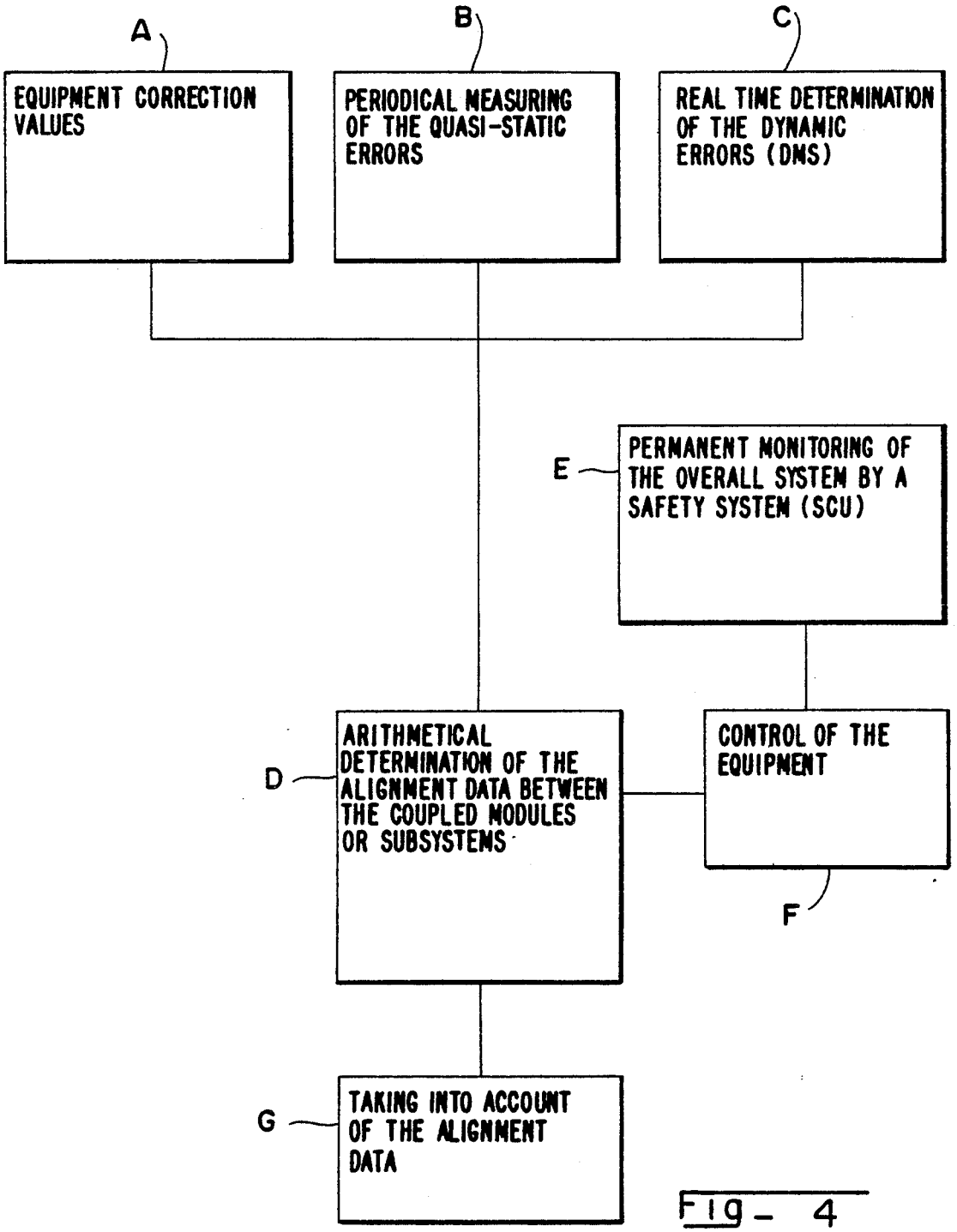
FIG. 4 shows a chart or block diagram of the inventive method steps for compensating alignment errors in a modular interlinked marine fire-control system constructed according to the invention.

For determining the dynamic alignment errors caused by the movements of the ship, vibrations and the like, there is provided a deformation measuring system DMS (FIG. 4). To that end, preferably every equipment module GMi and TMi comprises a sensor. It is advantageous to arrange the equipment units or modules within a subsystem in such a manner on the ship that the relative position of the equipment units or modules with respect to one another is practically not affected by movements of the ship. This can be achieved by bracing or stiffening of the ship's hull or by a uniform or standard foundation or bedding in this area or zone and by the smallest possible distance between the equipment units or modules within a subsystem. This measure may possibly ensure that the subsystems as such can be regarded as rigid relative to dynamic deviations, or that the movements of the individual modules GMi and TMi can be regarded as identical, and that not every module need be equipped with a sensor, but that every subsystem contains only one common sensor. In most cases, the cost factor will determine which measure, namely hull bracing or additional sensors, will be given preference. However, the problem of complex interlinking should in no case limit the aforesaid procedure, as it is after all the very object of the invention to make complex interlinking operable.

The sensors of this deformation measuring system DMS measure the rotational speeds and the linear accelerations. The results of these measurements are processed and illustrated by the associated computer preferably in a north-oriented horizon system $\rho_H$. Therefore, the sensors continuously supply the parameters required for determining the position. Strapdown sensor blocks having suitable measuring devices are thereby used in known manner. For this purpose, these strapdown sensor blocks preferably contain three accelerometers and at least two strapdown gyros or gyroscopes. The accelerometers furnish thereby the information on the linear displacements of the respective units or modules and the gyros furnish the corresponding information on rotational movements. It is obvious that for determining the compensation parameters, there can be used any kinematical data which are related to the acceleration or the angular velocity of the units or modules to be evaluated. These data measured by means of sensors are evaluated by a suitable algorithm, and preferably detected as a compensation matrix $A_{ij}$ which indicates in the form of small Cardan or canting angles the relative twist of two equipment units or modules with respect to one another.

The compensation matrix $A_{ij}$ contains the information on the misalignment or the alignment error between the units i and j and renders possible the compensation of this alignment error in that the respective control vector for the control of a gun module j by a radar module i, which radar module i contains the data for the alignment of the gun to the target, is determined by taking into account this compensation matrix $A_{ij}$. During the control of a gun module j by the corresponding or associated radar module i, the dynamic alignment errors can be corrected by means of this compensation matrix $A_{ij}$.

However, since the values measured by the accelerometers and the gyros, respectively, are influenced by the rotatary as well as by the translatory movements such that an interdependence exists, the calculation of the compensation matrix $A_{ij}$ requires a considerable computational expenditure.

An algorithm for determining the compensation parameters can be carried out, for example, by using a Kalman filter in that the angle increments of the corresponding units as well as the velocity increments thereof are used as input values. The basic mode of operation of such an algorithm is described, for example, in the publication "Kalman Filter Formulations for Transfer Alignment of Strapdown Inertial Units" of Alan M. Schneider, in NAVIGATION, Journal of the Institute of Navigation, Vol. 30, No. 1, Spring 1983. The individual measuring periods for determining the angle increments and velocity increments are, for example, 20 milliseconds. The computational work or expenditure associated with an algorithm when using a Kalman filter can be substantially reduced in that the algorithm employs a filtering method with which, by means of the measured data of the accelerometers, the measured values of the gyros are filtered as described hereinafter in chapter IV.A. Such an algorithm permits, for example, in the event of a take-over of the control of a gun by the radar module of another subsystem, extremely short response times of approximately three minutes.

Preferably, within the framework of the inventive method, the following data are determined for the deformation measuring system DMS:

a) Stationary or quasi-stationary input values:
   - azimuth-alignment deviation between the sensor blocks
   - parallaxes between the sensor blocks b) Dynamic measured values:
   - the linear acceleration a of $\Sigma_D$ with regard to $\Sigma_I$ of each sensor block
   - angular velocity w of $\Sigma_D$ with regard to $\Sigma_I$ of each sensor block c) Output values (dynamic, band-limited):
   - relative twist between the sensor blocks (small Cardan angles)

Moreover, if the position of $\Sigma_D$ in $\Sigma_H$ is indicated, then, in addition, the navigation parameters are required for the relation between $\Sigma_D$ and $\Sigma_H$.

$\Sigma_D$ thereby denotes a ship-related Cartesian system of coordinates and $\Sigma_H$ an earth-surface-related Cartesian system of coordinates with the center thereof in the ship's deck and an axis directed toward the center of the earth. $\Sigma_I$ is an inertial system of coordinates with the center in the center of the earth.

The values of the compensation matrix $A_{ij}$ are determined in analogous manner to the calculation of static correction matrixes. The evaluation algorithm for determining the compensation matrix $A_{ij}$ between two sensors i and j preferably requires, as input values, the angle increments, i.e. the integral of the angular velocity over a specific measuring period of time, for instance 20 milliseconds, the velocity increments, i.e. the integral of the translatory velocities during a corresponding measuring period of time, and the stationary azimuth alignment deviations, as well as the parallax vectors between the sensors. These input values are evaluated by means of a computer or decentralized computer units in real time, so that per measuring period the alignment error angles about the axes of the reference system are available as correction data. The evaluation is effected, for example, with a timing frequency of 50 cycles per second.

IV. Method for optimizing the readiness for action and the accuracy of the fire-control system FIG. 4 shows a schematic block chart of the method according to the invention in conjunction with the exemplary embodiment described hereinbefore and having independent subsystems, the radar modules of which can take over the control of gun modules of other subsystems, or make available to such other subsystems the data required for alignment-error correction. The blocks A through C relate to the detection or acquisition of the required correction data. There are thereby detected the static deviations (block A), the quasi-static deviations (block B) and the dynamic deviations (block C). Such data are centrally or decentrally evaluated by computer units (block D). This evaluation is effected by determining the compensation parameters, among others the correction matrixes $A_{ij}$, whereby, in principal, the latter need only be determined for the coupled equipment modules. By permanent monitoring of the condition of the system, an optimum readiness for action is achieved by controlling the interlinking of the individual modules or subsystems (blocks E and F). The calculated values are taken into account as alignment data during operation or combat (block G).

As the compensation parameters are already affected by minor deviations of the sensors, attention must be paid to the time stability of these sensors. The accelerometers support the gyro measurement with regard to drift in two axes. Since the perpendicular axis cannot be supported for physical reasons, the angular twist about this perpendicular axis must be accurately measured from time to time.

IV. A. Determining the compensation parameters by means of an algorithm

In order to determine the input values for the algorithm, conventional sensors, preferably strapdown sensors, can be used.

Figure 5A:
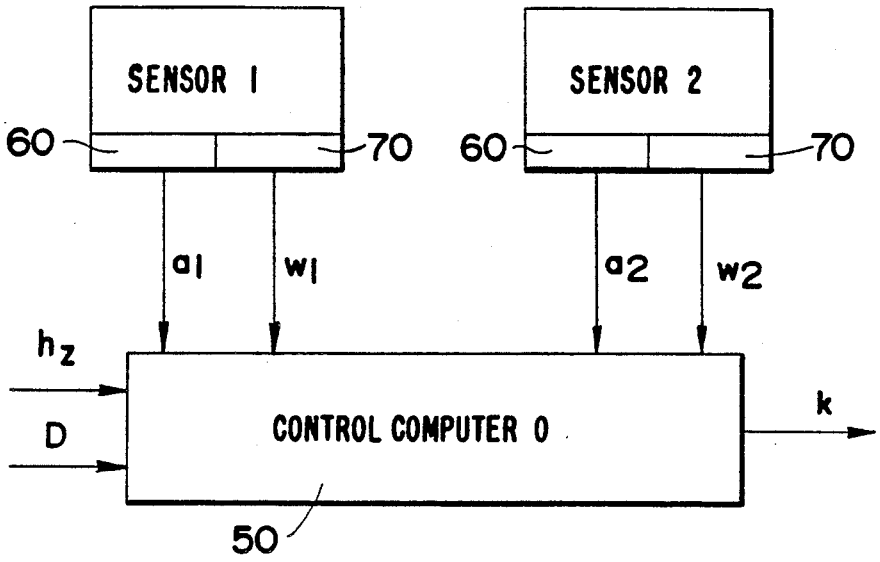
FIG. 5A schematically shows the process sequence for correcting dynamic alignment errors.

FIG. 5A schematically shows the determination of the alignment data between two subsystems by the deformation measuring system DMS. A first sensor SENS1 is provided at an equipment unit or module of a first subsystem not particularly shown in the drawing. A second sensor SENS2 is provided at an equipment unit or module of a second subsystem which is also not particularly shown in the drawing. These sensors SENS1 and SENS2, equipped with accelerometers or acceleration meters 60 and gyros or gyroscopes 70, may be used, for example, for navigation purposes, in which case they continuously indicate position coordinates and rotational velocities in a spatially stationary system of coordinates, and/or for determining stabilization data for the associated equipment unit or module. However, the internal signals of these sensors SENS1 and SENS2 can also be processed such that they indicate the angular velocities $w_1$ and $w_2$ of the rotations about their own axes and the accelerations $a_1$ and $a_2$ in the direction of these axes. The output values of the sensors SENS1 and SENS2 represent the input values of the computer part COMP 0 of the deformation measuring system DMS. Further input values of the computer part COMP are the parallax value D between the sensors SENS1 and SENS2 and the quasi-static deviation $h_2$ of the alignment of the sensors SENS1 and SENS2 about the perpendicular axis. The quasi-static deviation $h_2$ is required because the sensors themselves cannot supply any support of the data on the rotation about this axis. The computer part COMP 0 delivers at the output the small Cardan angles k, which indicate the twist of two sensor blocks relative to one another.

Figure 5B:
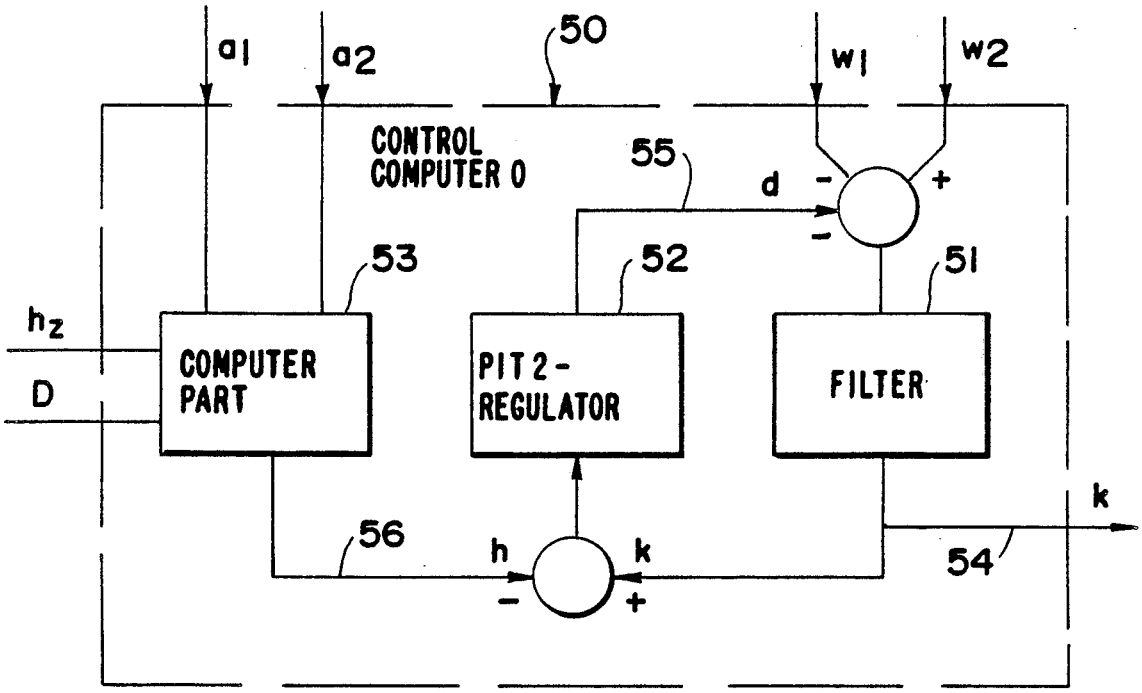
FIG. 5B schematically shows in greater detail the computer part of the process sequence for correcting dynamic alignment errors.

A possible mode of operation of the computer part COMP 0 designated by reference numeral 50 for determining the Cardan angles k from the aforementioned input signals, is illustrated in detail, by way of example, in FIG. 5B. The measuring of the angular velocities $w_1$ and $w_2$ is, in the short term, very accurate and the differences thereof integrated over time furnish, in principal, the wanted relative Cardan or canting angles k. Higher frequency signal portions in the angular velocity, for example, originating from vibrations, are not of interest here, since they cannot be considered anyway during the follow-up control of the target axes of the equipment of the fire-control system for performing the fire control task. Therefore, the Cardan angles k at line 54 are obtained in a filter 51 having a band width specific for the application in question, for instance five cycles per second, by an integration, for instance in the manner $$dk/dt = A(w_1 k + w_1 - w_2 - d.$$

The correction d transmitted via line 55 serves to neutralize the inherently existing drift when measuring velocities by means of gyros.

The relative canting angles can also be determined with the aid of the acceleration measurements, whereby the faster processes may, of course, be reproduced only with inadequate accuracy. However, as viewed in the long term, the determination of the relative canting angles is very accurate. It is therefore advantageous when in a computer part 53 the measured acceleration values $a_1$ and $a_2$ are first filtered in a low-pass manner and subsequently are used for determining the canting angles h transmitted via line 56, for example, according to the formula:

$$B(a_2)h = a_2 - a_1 - F(dw_1/dt, w_1)D.$$

Without the correction d transmitted via line 55, the Cardan angles k would contain the relevant dynamic portion and a drift which in contrast thereto changes slowly; the canting angles h contain only a part of the relevant frequency portions, but on the average is accurate and stable over a longer period of time. The subtraction k minus h contains, therefore, a portion of the relevant frequencies and the drift. By means of a regulator or control unit 52, for example, in the form of a PIT2-regulator with a time constant of approximately 10 seconds, which supplies the correction signal d along line 55, the relevant frequency portions are suppressed and the drift compensated.

The FIGS. 5A and 5B illustrate the determination of alignment data between two subsystems, whereby the output values of the sensors SENS1 and SENS2 are the input values of the computer COMP 0 which is part of the deformation measuring system DMS. In other words, the fire-control system is interlinked in the manner depicted in FIGS. 2A and 3A. However, it is readily conceivable that the system of determining alignment data between two subsystems as depicted in FIGS. 5A and 5B can be also carried out in a fire-control system which is interlinked in the manner depicted in FIGS. 2B and 3B. The thereby required computer part of the deformation measuring system DMS would be in such case the control computer COMP2 of the respective effector module.

IV. B. Monitoring and control of the readiness for action by a system-control-unit SCU During the operation of the fire-control system a permanent monitoring of the equipment modules takes place by an indirect or referring safety system or the system-control-unit SCU. In this way, failures of one or several equipment modules can be determined at any time. Due to revision work, equipment defects or damage suffered by the equipment in action, the readiness for action of individual subsystems and, accordingly, of the overall fire-control system may be critically reduced. This safety system could be ensured in the simplest manner by a supervising person effecting the necessary coupling of the modules, whereby a long reaction time to system changes would have to be put up with. By virtue of the interlinking of the subsystems or of the modules, respectively, of the fire-control system constructed according to the invention, it is possible for equipment units of different subsystems to cooperate or interact, such that the failure of individual equipment modules can be compensated. According to the object of the invention, the safety system must operate efficiently, i.e. it must be characterized by as short as possible outage times as well as by low additional material requirements and costs. By means of a suitable automatized control, the readiness for action of the overall fire-control system can be optimized. In this manner, the overall system possesses a so-called self-acting organization, so that the connections realized in each instance between the individual modules can be adapted to new situations within the shortest of time. Preferably, all modules provided with a sensor SENS possess an automatic self-checking device, as generally indicated by reference numeral 90 in FIGS. 1 and 3A. If disturbances or a failure occur, a central monitoring device, preferably a central computer unit, ensures a re-organization of the fire-control system, i.e. the readiness for action is optimized by suitable interlinking of the individual modules. A switching-over between different equipment modules, i.e. different target detection modules, may also become necessary or desirable in order to obtain improved visibility, i.e. optimum target acquisition possibilities. An automatized system-control-unit SCU accordingly supplements the redundant interlinking of the system and permits a re-structuring or new interlinking of the system within the shortest possible time. Naturally, also a number of safety systems may be used simultaneously.

During the switching-over process from a defective to an intact target detection module, as little time as possible should elapse, so that the equipment outage time is as short as possible. Since during normal operation the algorithm used for the compensation of dynamic alignment errors is not used or then is used only within the subsystems, it must be designed such that in order to meet this requirement the response time during the switch-over between two equipment modules of different subsystems is short.

The fire-control system constructed according to the invention permits the realization of an active redundancy in that, for example, specially provided equipment modules, i.e. target detection and effector modules, are available at any time to operate in conjunction with two or more other modules substantially without response time.

Every module or subsystem comprises suitable computer units for the control and evaluation of the compensation parameters. The detection of alignment errors between two subsystems is preferably effected by means of a central computer unit, among others by using the algorithm for determining the compensation matrix $A_{ij}$. Since the algorithm is always used to determine the relative position of equipment modules of different subsystems, a certain response time of the algorithm is caused subsequent to switching-over between two radar modules. For this reason, where frequent failures of equipment units are expected, it may be advantageous to interlink all radar modules with all gun modules, so that by means of the algorithm their positions relative to one another are known at any time, and the response times can thus be avoided. In this case, actual subsystems no longer exist, the fire-control system now forming a uniform interlinked system. However this concept requires a far more complicated cabling as well as considerably more computational expenditure by the computer systems. Therefore, it is necessary to decide from case to case, taking into account the equipment units used, the type and location of use etc., as to how the individual modules are to be connected. Also other interlinking concepts are conceivable, for example, a combination of the two interlinking methods described hereinbefore in conjunction with FIGS. 2A and 2B.

Where there are shown and described present preferred embodiments of the invention, it is to be distinctly understood that the invention is not limited thereto, but may be otherwise variously embodied and practiced within the scope of the following claims.

What we claim is:

1. A modular interlinked marine fire-control system, comprising:

a plurality of subsystems, each subsystem comprising:

a target detection module; and an effector module that is operatively associated with said target detection module;

means for compensating for a static alignment error and a quasi-static alignment error that occurs between said target detection module and said effector module;

means for detecting a dynamic alignment error that occurs between said target detection module and said effector module of said subsystem;

a computer that is connected to said detecting means of each subsystem; and a control computer that is connected to said effector module of each subsystem, said computer transmitting data obtained by said detecting means to said control computer to compensate for the occurrence of said dynamic alignment error of said subsystem.

2. The modular interlinked marine fire-control system of claim 1, wherein:

said detecting means of each subsystem comprises a sensor that is located at said target detection module of said subsystem and a further sensor that is located at said effector module of said subsystem;

said computer being connected to said sensor located at said target detection module; and said further sensor being connected to said control computer.

3. The modular interlinked marine fire-control system of claim 1, further comprising:

an additional computer that is connected to each subsystem, said additional computer serving to determine dynamic alignment errors between said plurality of subsystems, said additional computer transmitting data that is used for compensating said dynamic alignment errors of said subsystems relative to each other.

4. The modular interlinked marine fire-control system of claim 1, further comprising:

a system control unit that is connected to said target detection module and said effector module in each one of said plurality of subsystems, said target detection module and said effector module of each of said plurality of subsystems being interlinked with one another, said system control unit serving to monitor and control said interlinking of said target detection module and said effector module of each of said plurality of subsystems relative to one another.

5. The modular interlinked marine fire-control system of claim 4, further comprising:

an automatic self-checking unit that is provided in each target detection module and in each effector module of said plurality of subsystems; and a data transmission line, said system control unit comprising a central computer unit that is connected via said data transmission line to said automatic self-checking unit.

6. The modular interlinked marine fire-control system of claim 1, further comprising:

a system control unit that is connected to said plurality of subsystems, said plurality of subsystems being interlinked with one another, said system control unit serving to monitor and control an interlinking of said plurality of subsystems relative to one another.

7. The modular interlinked marine fire-control system of claim 6, further comprising:

an automatic self-checking unit that is provided in each target detection module and in each effector module of said plurality of subsystems; and a data transmission line, said system control unit comprising a central computer unit that is connected via data transmission line to said automatic self-checking unit.

8. The modular interlinked marine fire-control system of claim 2, wherein:

said sensor comprises three accelerometers and two gyros; and said further sensor comprises three accelerometers and two gyros, said accelerometers and said gyros functioning to measure translatory and rotational movements and to determine angle increments and translational velocity increments.

9. The modular interlinked marine fire-control system of claim 8, wherein:

said target detection module and said effector module of each one of said plurality of subsystems are interconnected to one another for reciprocally transmitting data regarding dynamic alignment errors; and said plurality of subsystems being interconnected with one another for reciprocally transmitting data regarding said dynamic alignment errors, said dynamic alignment errors comprising data regarding a position and movement of said target detection module and said effector module of each one of said plurality of subsystems and data regarding a position and movement of said plurality of subsystems relative to one another.

10. The modular interlinked marine fire-control of claim 8, wherein:

each effector module in each one of said plurality of subsystems is connected to each target detection module in said plurality of subsystems for transmitting data between said subsystems.

11. The modular interlinked marine fire-control system of claim 10, wherein:

said target detection module and said further sensor at each effector module in each one of said plurality of subsystems functions to determine dynamic alignment errors, said dynamic alignment errors comprising data regarding a relative dynamic movement and position of said target detection module and said effector module relative to each other.

12. The modular interlinked marine fire-control system of claim 1, further comprising;

a common data bus that is connected to each one of said plurality of subsystems, said common data bus being provided for transmitting data between said plurality of subsystems.

13. The modular interlinked marine fire-control system of claim 3, further comprising:

a common data bus that is connected to said additional computer, said target detection module and said effector module in each one of said plurality of subsystems, said common data bus being provided for transmitting data within each one of said plurality of subsystems, between said plurality of subsystems, and between said additional computer and said plurality of subsystems.

14. The modular interlinked marine fire-control system of claim 2, further comprising:

a target detecting sensor that is associated with said target detection module and said effector module in each one of said plurality of subsystems;

said target detecting sensor defining a target measuring line-of-sight to a measuring target, said computer and said control computer having means for detecting and storing a line-of-sight deviation that determines said quasi-static alignment error.

15. A method for compensating static quasi-static and dynamic alignment errors in a modular interlinked marine fire-control system, comprising the steps of:

(a) determining a first data that represents first compensation parameters of the static and quasi-static alignment errors and parallax distances between a target detection module and an effector module associated with each of a plurality of subsystems, and second compensation parameters of the dynamic alignment errors and the parallax distances between different subsystems;

(b) determining a second data that represents dynamic angle increments and axial velocity increments and corresponding angle changes and relative velocities of the subsystems and of the target detection module and the effector module associated with each of said plurality of subsystems;

(c) processing the first and second determined data with a computer so as to determine correction matrixes between individual subsystems and between target detection modules and effector modules of the plurality of subsystems; and (d) using the first and second compensation parameters to control the effector modules of the plurality of subsystems.

16. The method of claim 15, further comprising the steps of:

monitoring a readiness for action and an accuracy of the target detection modules and effector modules of the plurality of subsystems with a control unit; and automatically switching from one target detection module to another target detection module of respective subsystems of the plurality of subsystems by the system control unit in order to optimize a target detection and subsequent optimized coupling of the effector modules and the target detection modules of the plurality of subsystems.

17. The method of as defined in claim 15, further comprising:

monitoring a readiness for action and an accuracy of the target detection modules and the effector modules of the plurality of subsystems with a system control unit; and manually switching from one target detection module to another target detection module of respective subsystems of the plurality of subsystems by the system control unit by changing a data flow in an event of a failure or a shutdown of a target detection module in one of the plurality of subsystems in order to optimize a target detection and subsequent optimized coupling of the effector modules and the target detection modules of the plurality of subsystems.

18. The method of claim 15, wherein:

the step of determining the compensation parameters of the static and quasi-static alignment errors comprises determining and storing such compensation parameters by comparing a line-of-sight deviation between a target detection module and an associated detector module directed to a common moving measuring target.

19. The method of claim 15, wherein:

the step of determining the correction matrixes between the individual subsystems and between the target detection modules and the effector modules comprises providing in time intervals of a maximum 20 milliseconds measured data required for determining the correction matrixes, and calculating the correction matrixes with a timing frequency of at least 50 cycles per second.

20. The method of claim 15, wherein:

the step of determining the correction matrixes between the individual subsystems and between the target detection modules and the effector modules comprises using a plurality of accelerometer and gyro sensors for providing measured values required for determining the correction matrixes, and evaluating the measured values in a filter process in which the measured values of the gyro sensors are filtered by means of the measured values of the accelerometers.

21. The method of claim 15, further comprising the step of:

determining at least two redundant correction matrixes.

* * * * *